US010731484B2

(12) United States Patent
Bordne et al.

(10) Patent No.: US 10,731,484 B2
(45) Date of Patent: Aug. 4, 2020

(54) BLISK RIM FACE UNDERCUT

(71) Applicant: General Electric Company, Schenectady, NY (US)

(72) Inventors: Christopher Mark Bordne, Victorville, CA (US); Jason Francis Pepi, North Andover, MA (US); Kevin Robert Shannon, Boston, MA (US)

(73) Assignee: General Electric Company, Schenectady, NY (US)

( * ) Notice: Subject to any disclaimer, the term of this patent is extended or adjusted under 35 U.S.C. 154(b) by 363 days.

(21) Appl. No.: 14/920,208

(22) Filed: Oct. 22, 2015

(65) Prior Publication Data

US 2016/0138408 A1 May 19, 2016

Related U.S. Application Data

(60) Provisional application No. 62/080,770, filed on Nov. 17, 2014.

(51) Int. Cl.
*F01D 5/34* (2006.01)
*F01D 5/14* (2006.01)
(Continued)

(52) U.S. Cl.
CPC ..... *F01D 5/34* (2013.01); *F01D 5/066* (2013.01); *F01D 5/147* (2013.01); *F01D 11/001* (2013.01);
(Continued)

(58) Field of Classification Search
CPC . F01D 5/34; F01D 5/066; F01D 5/147; F05D 2240/80; F05D 2240/30; F05D 2220/32; F05D 2260/941
See application file for complete search history.

(56) References Cited

U.S. PATENT DOCUMENTS 5,537,814 A * 7/1996 Nastuk ..... F01D 5/066 60/796
5,567,116 A 10/1996 Bourcier
(Continued)

FOREIGN PATENT DOCUMENTS

EP 2011965 A2 1/2009
EP 2186997 A2 5/2010
(Continued)

OTHER PUBLICATIONS

European Search Report and Opinion issued in connection with corresponding EP Application No. 15194909.6 dated May 3, 2016.
(Continued)

*Primary Examiner* — Aaron R Eastman
*Assistant Examiner* — Adam W Brown
(74) *Attorney, Agent, or Firm* — Hanley, Flight and Zimmerman, LLC

(57) ABSTRACT

A high pressure BLISK includes at least one circular row of airfoils circumferentially disposed about, integral with, and extending radially outwardly from an annular rim having an annular flat aft facing face with coplanar radially outer and inner face portions radially separated by an annular undercut extending into the rim from the aft facing face. Airfoil roots including root fillets extend around the airfoil between the rim and pressure and suction sides of the airfoils. An axially aftwardly extending annular cylindrical section extends aftwardly from the flat face. The BLISK being a first of axially adjacent first and second rotor sections connected by a rabbet joint. A forward arm of the second rotor section includes an outer forward facing annular face spaced apart from the aft facing face radially outwardly of the annular undercut and a radially inner forward facing annular face contacting the aft facing face.

14 Claims, 5 Drawing Sheets

(51) Int. Cl.
*F01D 5/06* (2006.01)
*F01D 11/00* (2006.01)

(52) U.S. Cl.
CPC ..... *F05D 2220/32* (2013.01); *F05D 2240/30* (2013.01); *F05D 2240/80* (2013.01); *F05D 2260/941* (2013.01)

(56) References Cited

U.S. PATENT DOCUMENTS 5,947,687 A 9/1999 Mori et al.
6,019,580 A 2/2000 Barr et al.
6,390,775 B1 * 5/2002 Paz ..... F01D 5/14 416/193 A
6,666,653 B1 * 12/2003 Carrier ..... F01D 5/3061 29/889.21
6,761,536 B1 * 7/2004 Bash ..... F01D 5/18 416/193 A
6,951,447 B2 * 10/2005 Cherolis ..... F01D 5/141 416/193 A
7,153,102 B2 12/2006 Stone
7,252,481 B2 * 8/2007 Stone ..... F01D 5/02 416/239
8,152,471 B2 * 4/2012 Pichel ..... F01D 5/066 416/198 A
8,287,241 B2 * 10/2012 Strohl ..... F01D 5/141 416/190
8,992,168 B2 * 3/2015 Norris ..... F01D 11/005 415/173.7
2007/0297897 A1 12/2007 Tran et al.
2010/0158742 A1 * 6/2010 Voice ..... B22F 3/15 419/49
2011/0223025 A1 * 9/2011 Schutte ..... F01D 5/066 416/193 A
2016/0201466 A1 * 7/2016 Fink ..... F01D 11/001 416/185

FOREIGN PATENT DOCUMENTS

EP 2365183 A2 9/2011
WO 2011102984 A2 8/2011

OTHER PUBLICATIONS

Unofficial English Translation of Chinese Office Action issued in connection with Corresponding CN Application No. 201511036157.0 dated Oct. 31, 2016.

* cited by examiner

BLISK RIM FACE UNDERCUT

GOVERNMENT INTERESTS

This invention was made with government support under government contract No. W911W6-07-2-0002 by the Department of Defense. The government has certain rights to this invention.

BACKGROUND OF THE INVENTION

Field

The present invention relates generally to gas turbine engine turbine rotor supported blades and, more specifically, to undercuts beneath such blades.

Description of Related Art

Several types of gas turbine engines include a high pressure rotor having an axial high pressure compressor (HPC) joined to a high pressure turbine (HPT) to form a high pressure rotor. The HPC typically includes one or more connected stages. Each HPC stage includes a row of compressor blades or airfoils extending radially outwardly from an annular outer rim of a compressor disk, BLISK, or BLUM. A single tie bolt or tie rod, through a high pressure rotor bore of the high pressure rotor, is tightened and secured by a lock-nut used to clamp together and place the high pressure rotor in compression. The rotor bore is spaced apart from and circumscribes the tie rod. Such rotors are well known and an example of one is disclosed in U.S. Pat. No. 5,537,814, entitled "High pressure gas generator rotor tie rod system for gas turbine engine", which issued Jul. 23, 1996, and is assigned to the present assignee, the General Electric Company, and which is incorporated herein by reference.

One particular HPC rotor design includes a plurality of compressor and turbine rotor components referred to as integrally bladed rotors. Examples of integrally bladed rotors includes integrally bladed disks commonly referred to as BLISKS and integrally bladed drums referred to as BLUMS. Such rotor components are often connected to adjacent rotor components connected in rotational driving engagement by radial face splines, typically referred to as Curvic couplings, or other non-bolted connections such as rabbets. BLISKS may be tandem BLISKS having two or more axially adjacent rows of blades or airfoils extending radially outwardly from the annular outer rim of the BLISK.

A single rotor may span solely on a compressor or turbine rotor or alternatively an entire gas generator rotor assembly, applying a compressive load therethrough to prevent separation of the compressor and turbine components and related hardware.

A high tie rod load may be imparted through the blisks of a high pressure compressor (HPC), which together with the shape of a flowpath of the HPC, cause a high compressive stress to be transferred out of a rim of the rotor blisk and into a trailing edge root of an airfoil of the rotor blisk. Thus, there is a need to reduce this high compressive stress transferred out of a rim of the rotor blisk and into a trailing edge root of an airfoil of the rotor blisk.

BRIEF DESCRIPTION

A gas turbine engine high pressure rotor BLISK includes at least one circular row of airfoils circumferentially disposed about, integral with, and extending radially outwardly from an annular rim integral with the BLISK. A web extends radially outwardly from the hub to the rim and the rim includes an annular flat aft facing face having coplanar radially outer and inner annular face portions radially separated by an annular undercut extending upstream or axially forwardly into the rim from the flat aft facing face.

The airfoils may extend radially outwardly from roots on the rim to airfoil tips and include radially extending pressure and suction sides extending axially or chordwise between axially spaced apart leading and trailing edges. The airfoil roots include root fillets extending around the airfoil between the rim and the pressure and suction sides from the leading edge to the trailing edge.

An axially aftwardly extending annular cylindrical section of the rim may extend aftwardly from the aft facing face. An annular stress relief fillet may extend radially and axially into a rim annular corner between an outer cylindrical surface of the annular section and the aft facing face.

A gas turbine engine high pressure rotor assembly includes axially adjacent first and second rotor sections; at least one circular row of airfoils circumferentially disposed about, integral with, and extending radially outwardly from an annular first rim integral with the first rotor section; a hub and a web extending radially outwardly from the hub to the first rim; and the first rim including an annular flat aft facing face having coplanar radially outer and inner annular face portions radially separated by an annular undercut extending upstream or axially forwardly into the first rim from the flat aft facing face.

The gas turbine engine high pressure rotor may also include the airfoils extending radially outwardly from roots on the first rim to airfoil tips, the airfoils including radially extending pressure and suction sides axially or chordwise extending between axially spaced apart leading and trailing edges, and the airfoil roots including root fillets extending around the airfoil between the first rim and the pressure and suction sides from the leading edge to the trailing edge.

The first rim may further include an axially aftwardly extending annular cylindrical section extending aftwardly from the aft facing face, a rabbet joint connecting the first and second rotor sections, an annular forward extension or arm of the second rotor section extending axially forwardly from an annular second rim of the second rotor section, and the rabbet joint engaging and in part joining the cylindrical section of the first rim to an annular forward end of the forward arm of the second rotor section.

The annular forward end of the forward arm may include radially adjacent annular and flat radially inner and outer forward facing annular faces, the outer forward facing annular face being slightly spaced apart axially from the aft facing face radially outwardly of the annular undercut, and an annular gap between the outer forward facing annular face and the aft facing face.

The first rim may include an annular stress relief fillet extending radially and axially into a rim annular corner between an outer cylindrical surface of the annular section and the aft facing face. The annular section may include a radially outer cylindrical surface mating with a radially inner cylindrical surface of the forward end of the forward arm of the second rotor section. The forward end of the forward arm may include a chamfered corner between the inner cylindrical surface and the flat radially inner forward facing annular face of the annular forward end.

DETAILED DESCRIPTION

Figure 1:
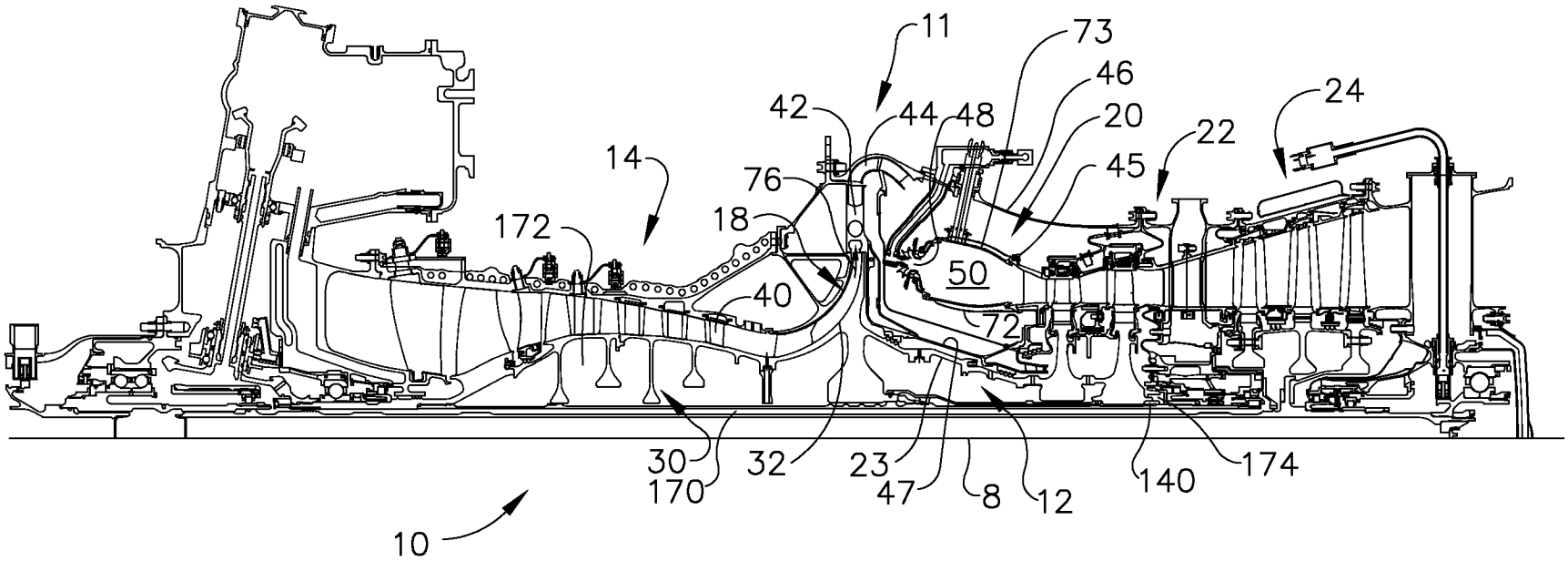
FIG. 1 is a sectional view diagrammatical illustration of a gas turbine engine with a high pressure rotor compressor having an undercut extending axially inwardly from a flat aft annular face of a first BLISK rim.

Illustrated in FIG. 1 gas turbine engine 10 circumscribed about an engine centerline axis 8 and including a high pressure gas generator 11 having a single stage centrifugal compressor 18. The high pressure gas generator 11 has a high pressure rotor 12 including, in downstream serial flow relationship, a high pressure compressor (HPC) 14, a combustor 20, and a high pressure turbine (HPT) 22. A low pressure turbine (LPT) 24 is downstream of the high pressure rotor 12. The HPT or high pressure turbine 22 is joined by a high pressure drive shaft 23 to the high pressure compressor 14 in what is referred to as the high pressure rotor 12. A single tie bolt or tie rod 170 is disposed through a rotor bore 172 of the high pressure rotor 12. A lock-nut 174 threaded on threads 140 on the tie rod 170 is used to tighten, secure, and clamp together and place the high pressure rotor 12 in compression.

The high pressure compressor 14 includes a high pressure centrifugal compressor stage 18 as a final compressor stage. The high pressure rotor 12 is rotatably supported about the engine centerline axis 8 by bearings in engine frames not illustrated herein. The exemplary embodiment of the high pressure compressor 14 illustrated herein includes a five stage axial compressor 30 followed by the centrifugal compressor stage 18 having an annular centrifugal compressor impeller 32. Outlet guide vanes 40 are disposed between the five stage axial compressor 30 and the single stage centrifugal compressor stage 18. Compressor discharge pressure (CDP) air 76 exits the impeller 32 and passes through a diffuser 42 annularly surrounding the impeller 32 and then through a deswirl cascade 44 into a combustion chamber 45 within the combustor 20. The combustion chamber 45 is surrounded by annular radially outer and inner combustor casings 46, 47. Air 76 is mixed with fuel provided by a plurality of fuel nozzles 48 and ignited and combusted in an annular combustion zone 50 bounded by annular radially outer and inner combustion liners 72, 73.

Figure 2:
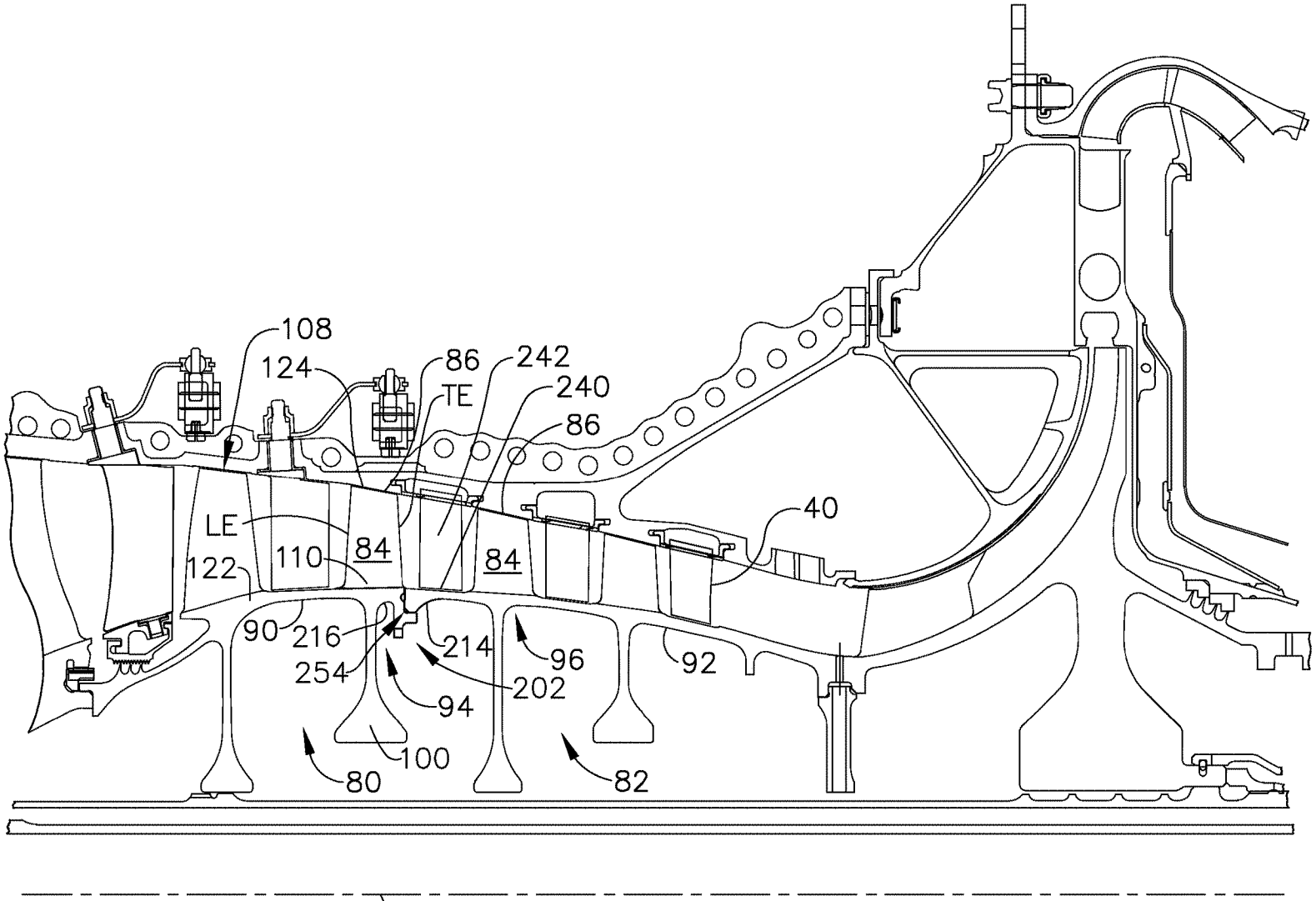
FIG. 2 is an enlarged sectional view diagrammatical illustration of the gas turbine engine high pressure compressor having the undercut extending axially inwardly from the flat aft annular face of the first BLISK rim illustrated in FIG. 1.

Referring to FIG. 2, the high pressure axial compressor 30 includes axially adjacent upstream and downstream or first and second rotor sections 80, 82 which carry a plurality of rotatable axial blades or airfoils 84 of the axial compressor 30. The first and second rotor sections 80, 82 may each carry two or more rows 86 of the axial blades or airfoils 84. The exemplary embodiment of the first and second rotor sections 80, 82 illustrated herein are first and second tandem BLISKs 90, 92 each one of which carry upstream and downstream rows or stages 94, 96 of integral blades or airfoils 84. One or both of the first and second rotor sections 80, 82 may be a single BLISK 90, 92 carrying a single row or stage of integral blades or airfoils 84.

Figure 3:
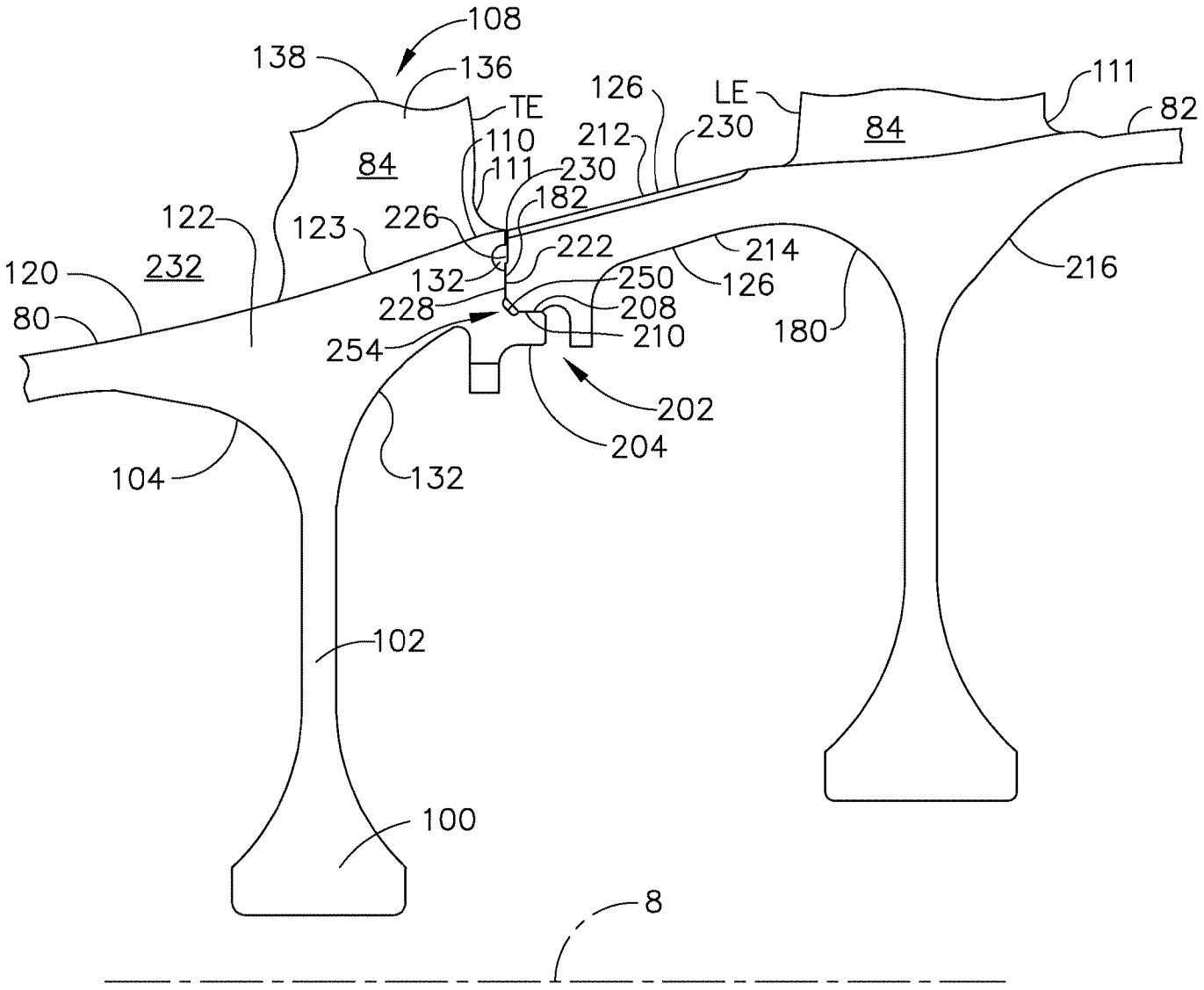
FIG. 3 is an enlarged diagrammatical sectional view illustration of the BLISK connected to an adjacent downstream second BLISK stage in the HPC illustrated in FIG. 2.

Referring to FIGS. 2 and 3, each of the upstream and downstream rows or stages 94, 96 includes a hub 100 and a web 102 extending radially outwardly from the hub 100 to a single solid annular rim 104. The annular rims 104 are integral with the first and second rotor sections 80, 82 and circumscribed around the engine centerline axis 8. A circular row 108 of the airfoils 84 are circumferentially disposed about and extend radially outwardly from the rim 104. Referring to FIGS. 2-5, the airfoils 84 are integral with the rim 104. The stages are radially continuous, solid, and uninterrupted through the hub 100 to and through the web 102 to and through the rim 104 and to and through the airfoils 84. Solid as is commonly defined and defined herein as being not hollow or containing spaces or gaps. Solid defined by Merriam Webster (https://www.merriam-webster.com/dictionary/solid) as being without an internal cavity or not interrupted by a break or opening such as a solid wall. This is the commonly accepted definition for solid particularly it pertains to gas turbine engine disks. The airfoils 84 extend radially outwardly from respective airfoil bases or roots 110 on a radially outer flowpath surface 120 of platforms 122 formed on a radially outer surface 123 of the rim 104 to airfoil tips 124. The airfoils 84 include radially extending pressure and suction sides 136, 138 axially or chordwise extending between axially spaced apart leading and trailing edges LE, TE. The airfoils 84 may be cambered and twisted. The airfoil roots 110 include root fillets 111 extending around the airfoil 84 between the radially outer surface 123 of the rim 104 and the pressure and suction sides 136, 138 from the leading edge LE to the trailing edge TE. The root fillets 111 provide a smooth transition between the radially outer surface of the disk rim and the blade airfoil surfaces of the pressure and suction sides 136, 138.

Figure 4:
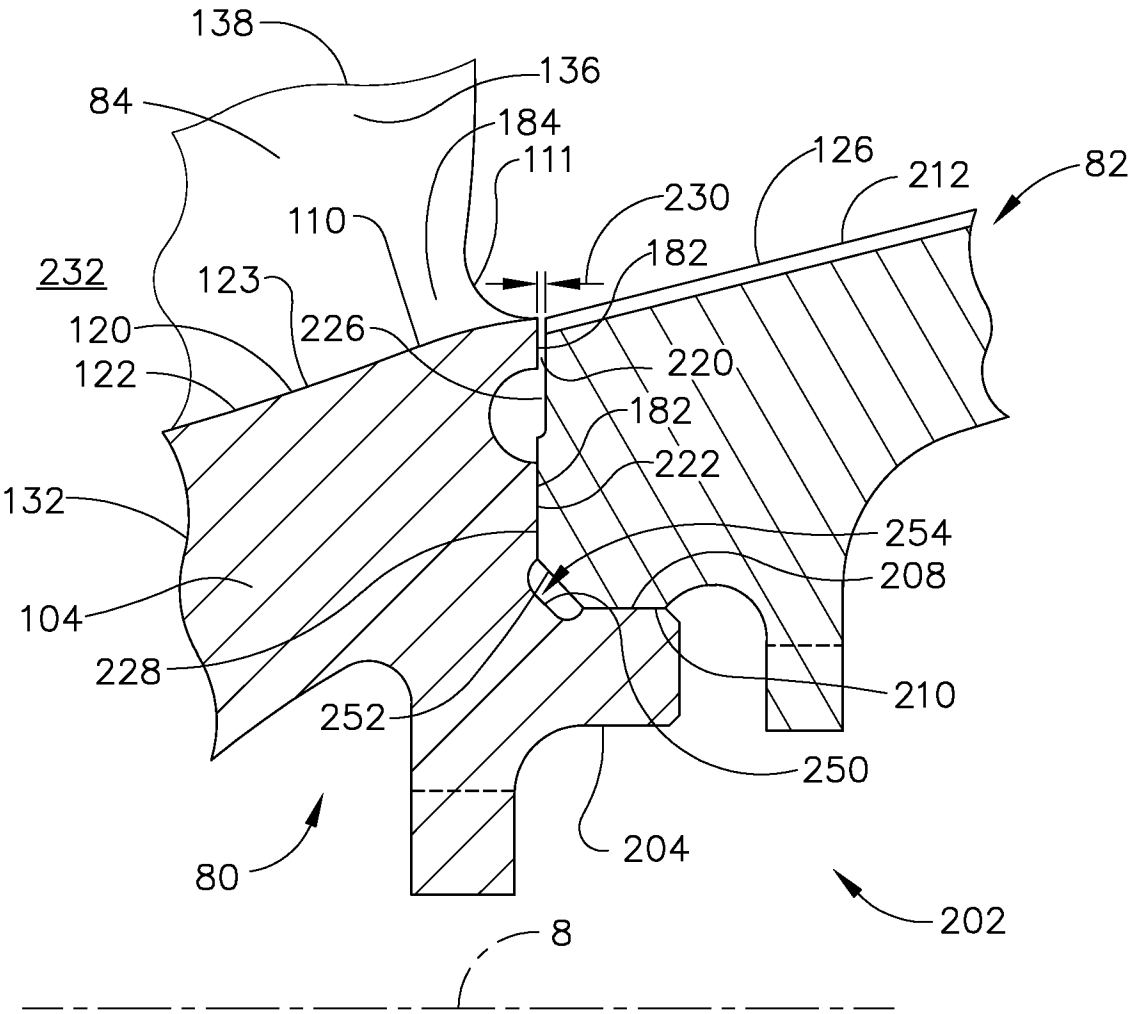
FIG. 4 is an enlarged sectional view illustration of a rabbet joint or connection between the first BLISK rim and a forward spacer arm of the second BLISK illustrated in FIG. 3.
Figure 5:
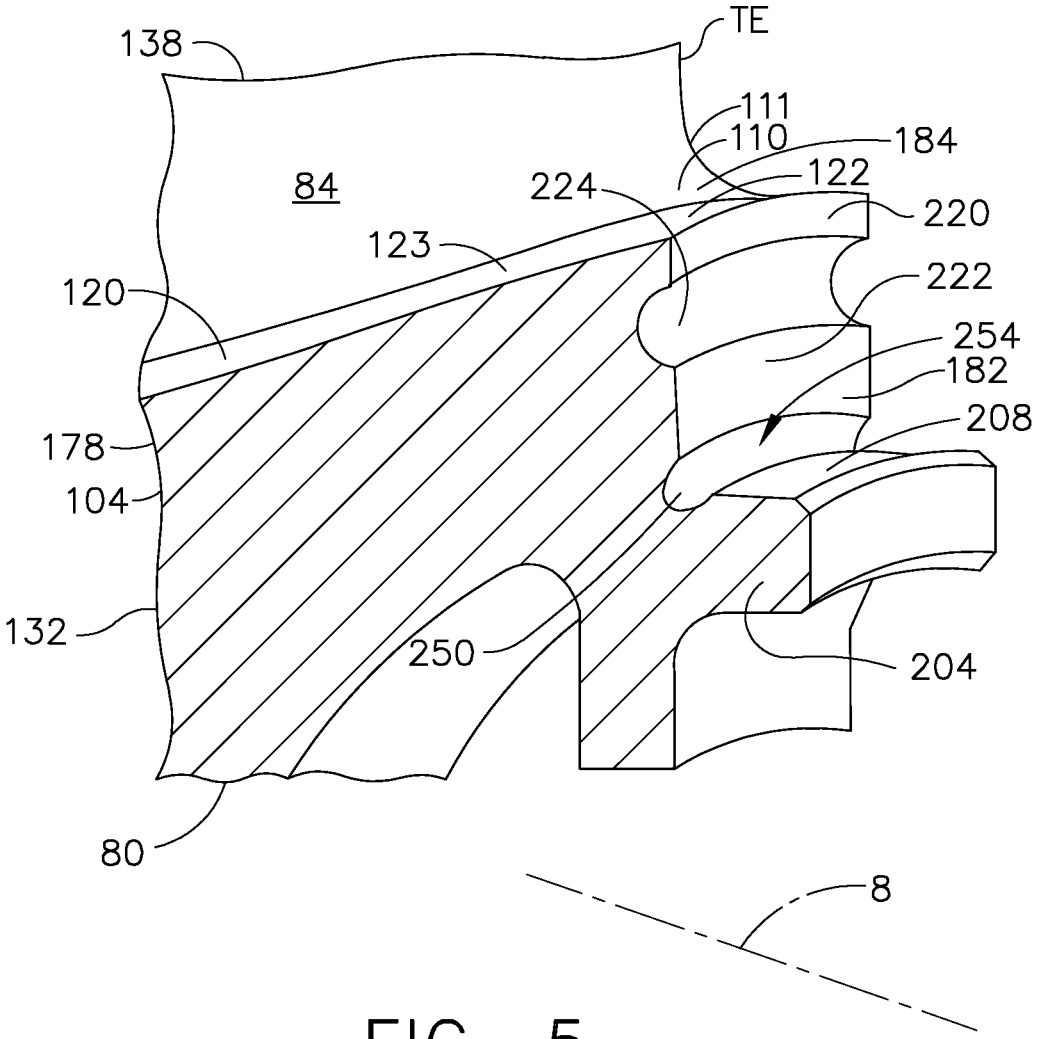
FIG. 5 is perspective view illustration of a sector of the first BLISK rim illustrated in FIG. 2.

Referring to FIGS. 3-5, the rim 104 of the first rotor section 80 has an annular flat aft facing surface or face 182. The root fillets 111 of the airfoils 84 extend downstream or aftwardly to or nearly to the aft facing face 182. In order to avoid or reduce high compressive stresses transferring out of the second rotor section 82 and into trailing edge root portions 184 of the airfoil roots 110, a first one 178 of the rims 104 ends at or near the trailing edge root portions 184 and a rabbet joint 202 is used to connect the first and second rotor sections 80, 82. An annular forward extension or arm 126 of the second rotor section 82 extends axially forwardly from a second one 180 of the rims 104 of the second rotor section 82 engages and is in part joined to an annular first rim 132 of the first rotor section 80 by the rabbet joint 202.

The rabbet joint 202 includes a downstream or an axially aftwardly extending annular cylindrical section 204 of the first rim 132 extending downstream or aftwardly from the flat face 182. The annular section 204 of the first rim 132 includes a radially outer cylindrical surface 208 that mates with a radially inner cylindrical surface 210 of an annular forward end 212 of the forward arm 126 of the second rotor section 82. The annular forward end 212 of the forward arm 126 of the second rotor section 82 includes radially adjacent annular and flat radially inner and outer forward facing annular faces 228, 226.

An annular stress relief fillet 250 also referred to as a machining relief fillet or stress and machining relief fillet extends radially and axially into a first rim annular corner 254 between the outer cylindrical surface 208 of the annular section 204 and the flat face 182 of the first rim 132. The annular stress relief fillet 250 is a joint undercut and serves a dual purpose of being able to re-cut the face, if diameter is off, and also larger fillet for relieving stress. A chamfered corner 252 between the inner cylindrical surface 210 and a radially inner cylindrical surface of the annular forward end 212 provides clearance to the adjacent annular stress relief fillet 250. The chamfered corner 252 also eases assembly of the rabbet joint 202 between the forward arm 126 of the second rotor section 82 and the first rim 132 of the first rotor section 80. The chamfered corner 252 also can't touch the stress relief fillet 250 under a worst case stack-up. The chamfered corner 252 also aids assembly of the rabbet joint by providing a ramp.

The flat aft facing face 182 circumferentially extends a full 360 degrees around the engine centerline axis 8 and includes coplanar radially outer and inner annular face portions 220, 222 radially separated by an annular undercut 224 extending upstream or axially forwardly into the first rim 132 of the first rotor section 80 from the flat aft facing face 182. The radially inner forward facing annular face 228 mates to and is compressed against the aft facing face 182 of the forward arm 126 below or radially inwardly of the annular undercut 224. Thus, the radially inner annular face portion 222 is a contacting surface of the rabbet joint 202. The inner and outer forward facing annular faces 228, 226 are not coplanar but rather they are axially offset.

The rotor bore 172 of the high pressure rotor 12 is in part bounded by the hubs 100 of the upstream and downstream rows or stages 94, 96. The tie rod 170 is disposed through the rotor bore 172 and the hubs 100 and placed in tension when the lock-nut 174 is tightened up, thus, clamping together and placing the high pressure rotor 12 in compression.

The flat aft facing face 182 circumferentially extends a fill 360 degrees around the engine centerline axis 8 and includes coplanar radially outer and inner annular face portions 220, 222 radially separated by, an annular undercut 224 extending upstream or axially forwardly into the first rim 132 of the first rotor section 80 from the flat aft facing face 182. The radially inner forward facing annular face 228 contacts, mates to and is compressed against the radially inner annular face portion 222 below or radially inwardly of the annular undercut 224. Thus, the radially inner annular face portion 222 is a contacting surface of the rabbet joint 202. The inner and outer forward facing annular faces 228, 226 are not coplanar but rather they are axially offset.

The radially outer forward facing annular face 226 is slightly spaced apart axially from the aft facing face 182 above or radially outwardly of the annular undercut 224 providing an annular gap 230 between the outer forward facing annular face 226 and the aft facing face 182. The radially outer forward facing annular face 226 is a small non-contacting face radially adjacent to the radially outer flowpath surface 120 in part bounding a flowpath 232.

A portion 214 of the annular forward arm 126 between the annular forward end 212 and an annular second rim 216 of the second rotor section 82 provides a rotating seal land 240. A stage of stator vanes 242 between the seal against rotating seal land 240 between the circular rows 108 of airfoils 84 on the first and second rims 132, 216.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims:

The invention claimed is:

1. A gas turbine engine high pressure rotor BLISK comprising:

at least one circular row of airfoils circumferentially disposed about, integral with, and extending radially outwardly from an annular rim integral with the BLISK;

a hub and a web extending radially outwardly from the hub to the rim; and the rim including an annular flat aft facing face having coplanar radially outer and inner annular face portions radially separated by an annular undercut extending upstream or axially forwardly into the rim from the flat aft facing face;

further comprising a downstream or an axially aftwardly extending annular cylindrical section of the rim extending downstream or aftwardly from the aft facing face and an annular stress relief fillet which is a joint undercut extending radially and axially into a rim annular corner between an outer cylindrical surface of the annular cylindrical section and the aft facing face.

2. The gas turbine engine high pressure rotor BLISK as claimed in claim 1 further comprising:

the airfoils extending radially outwardly from roots on the rim to airfoil tips, the airfoils including radially extending pressure and suction sides extending axially or chordwise between axially spaced apart leading and trailing edges, and the airfoil roots including root fillets extending around the airfoil between the rim and the pressure and suction sides from the leading edge to the trailing edge.

3. A gas turbine engine high pressure rotor assembly comprising:

axially adjacent upstream and downstream or first and second rotor sections, at least one circular row of airfoils circumferentially disposed about, integral with, and extending radially outwardly from an annular first rim integral with the first rotor section, a hub and a web extending radially outwardly from the hub to the first rim, and the first rim including an annular flat aft facing face having coplanar radially outer and inner annular face portions radially separated by an annular undercut extending upstream or axially forwardly into the first rim from the flat aft facing face; further comprising an annular forward extension or arm of the second rotor section extending axially forwardly from an annular second rim of the second rotor section, the annular forward end of the forward arm including radially adjacent and axially offset annular and flat radially inner and outer forward facing annular faces, the inner forward facing annular face contacting the inner aft facing face, the outer forward facing annular face being slightly spaced apart axially from the outer aft facing face radially outwardly of the annular undercut, and an annular gap between the outer forward facing annular face and the outer aft facing face.

4. The gas turbine engine high pressure rotor assembly as claimed in claim 3 further comprising:

the airfoils extending radially outwardly from roots on the first rim to airfoil tips, the airfoils including radially extending pressure and suction sides extending axially or chordwise between axially spaced apart leading and trailing edges, and the airfoil roots including root fillets extending around the airfoil between the first rim and the pressure and suction sides from the leading edge to the trailing edge.

5. The gas turbine engine high pressure rotor assembly as claimed in claim 4 further comprising:

a downstream or an axially aftwardly extending annular cylindrical section of the first rim extending downstream or aftwardly from the aft facing face, a rabbet joint connecting the first and second rotor sections, and the rabbet joint engaging and in part joining the cylindrical section of the first rim to an annular forward end of the forward arm of the second rotor section.

6. The gas turbine engine high pressure rotor assembly as claimed in claim 3 further comprising:

an annular stress relief fillet extending radially and axially into a rim annular corner between an outer cylindrical surface of the cylindrical section and the aft facing face, the radially outer cylindrical surface mating with a radially inner cylindrical surface of the forward end of the forward arm of the second rotor section, and a chamfered corner between the inner cylindrical surface and the flat radially inner forward facing annular face of the annular forward end.

7. The gas turbine engine high pressure rotor assembly as claimed in claim 3 further comprising:

a rotor bore disposed in the first and second rotor sections and bounded in part by the hub, a tie rod disposed through the rotor bore, and a lock nut threaded on threads on the tie rod placing the tie rod in tension and clamping the first and second rotor sections together.

8. The gas turbine engine high pressure rotor assembly as claimed in claim 7 further comprising:

a downstream or an axially aftwardly extending annular cylindrical section of the first rim extending downstream or aftwardly from the aft facing face, a rabbet joint connecting the first and second rotor sections, an annular forward extension or arm of the second rotor section extending axially forwardly from an annular second rim of the second rotor section, and the rabbet joint engaging and in part joining the cylindrical section of the first rim to an annular forward end of the forward arm of the second rotor section.

9. The gas turbine engine high pressure rotor assembly as claimed in claim 8 further comprising:

the annular forward end of the forward arm including radially adjacent annular and flat radially inner and outer forward facing annular faces, the outer forward facing annular face being slightly spaced apart axially from the aft facing face radially outwardly of the annular undercut, and an annular gap between the outer forward facing annular face and the aft facing face.

10. The gas turbine engine high pressure rotor assembly as claimed in claim 9 further comprising:

an annular stress relief fillet extending radially and axially into a rim annular corner between an outer cylindrical surface of the cylindrical section and the aft facing face, the radially outer cylindrical surface mating with a radially inner cylindrical surface of the forward end of the forward arm of the second rotor section, and a chamfered corner between the inner cylindrical surface and the flat radially inner forward facing annular face of the annular forward end.

11. A gas turbine engine high pressure rotor assembly comprising:

axially adjacent upstream and downstream or first and second rotor sections, at least one circular row of airfoils circumferentially disposed about, integral with, and extending radially outwardly from an annular first rim integral with the first rotor section, a hub and a web extending radially outwardly from the hub to the first rim, the first rim including an annular flat aft facing face having coplanar radially outer and inner annular face portions radially separated by an annular undercut extending upstream or axially forwardly into the first rim from the flat aft facing face, a downstream or an axially aftwardly extending annular cylindrical section of the first rim extending downstream or aftwardly from the aft facing face, a rabbet joint connecting the first and second rotor sections, an annular forward extension or arm of the second rotor section extending axially forwardly from an annular second rim of the second rotor section, the rabbet joint engaging and in part joining the cylindrical section of the first rim to an annular forward end of the forward arm of the second rotor section, the annular forward end of the forward arm including radially adjacent and axially offset annular and flat radially inner and outer forward facing annular faces, the inner forward facing annular face contacting the inner aft facing face, the outer forward facing annular face being slightly spaced apart axially from the outer aft facing face radially outwardly of the annular undercut, and an annular gap between the outer forward facing annular face and the outer aft facing face.

12. The gas turbine engine high pressure rotor assembly as claimed in claim 11 further comprising:

the airfoils extending radially outwardly from roots on the first rim to airfoil tips, the airfoils including radially extending pressure and suction sides extending axially or chordwise between axially spaced apart leading and trailing edges, and the airfoil roots including root fillets extending around the airfoil between the first rim and the pressure and suction sides from the leading edge to the trailing edge.

13. The gas turbine engine high pressure rotor assembly as claimed in claim 12 further comprising an annular stress relief fillet extending radially and axially into a rim annular corner between an outer cylindrical surface of the cylindrical section and the aft facing face and the radially outer cylindrical surface mating with a radially inner cylindrical surface of the forward end of the forward arm of the second rotor section.

14. The gas turbine engine high pressure rotor assembly as claimed in claim 11 further comprising:

a rotor bore disposed in the first and second rotor sections and bounded in part by the hub, a tie rod disposed through the rotor bore, and a lock nut threaded on threads on the tie rod placing the tie rod in tension and clamping the first and second rotor sections together.

* * * * *